US006892403B2

(12) United States Patent
Liljedahl

(10) Patent No.: US 6,892,403 B2
(45) Date of Patent: May 17, 2005

(54) HOISTING HARNESS

(75) Inventor: Gunnar Liljedahl, Luleå (SE)

(73) Assignee: Liko Research & Development AB, Lulea (SE)

( * ) Notice: Subject to any disclaimer, the term of this patent is extended or adjusted under 35 U.S.C. 154(b) by 0 days.

(21) Appl. No.: 10/363,702

(22) PCT Filed: Sep. 19, 2001

(86) PCT No.: PCT/SE01/02006

§ 371 (c)(1),
(2), (4) Date: Mar. 13, 2003

(87) PCT Pub. No.: WO02/43641

PCT Pub. Date: Jun. 6, 2002

(65) Prior Publication Data

US 2004/0031096 A1 Feb. 19, 2004

(30) Foreign Application Priority Data

Nov. 29, 2000 (SE) ..... 0004396

(51) Int. Cl.[7] ..... A61G 7/10; A61G 7/14
(52) U.S. Cl. ..... 5/89.1
(58) Field of Search ..... 5/89.1, 83.1, 81.1 R; 482/69; 294/140, 74

(56) References Cited

U.S. PATENT DOCUMENTS 4,922,860 A * 5/1990 Hutchings ..... 482/69
5,530,975 A * 7/1996 Firebaugh et al. ..... 5/81.1 T
6,289,534 B1 * 9/2001 Hakamiun et al. ..... 5/89.1

FOREIGN PATENT DOCUMENTS

GB 23117674 10/1997
SE 511982 1/2000

* cited by examiner

*Primary Examiner*—Alexander Grosz
(74) *Attorney, Agent, or Firm*—Jacobson Holman PLLC

(57) ABSTRACT

Hoisting harness for persons, where the lifting action takes place by a harness consisting of a seat-piece placed between the person's legs, to which seat-piece a rear-piece is connected, which runs against the person's back and further consists of a front piece which runs against the chest. The front-piece and the rear-piece in their free ends have loops to be applied to a lift hanger. In order to avoid that the harness shall not be too tight across the chest during the lifting action and that the harness is adaptable to the size of the person's body, the front-piece and the rear-piece are connected by two connecting bands each band passing one side of the body, whereby the length of the connecting bands between the front-piece and the rear-piece is adjustable.

3 Claims, 4 Drawing Sheets

HOISTING HARNESS

This is a nationalization of PCT/SE01/02006 filed Sep. 19, 2001 and published in English.

FIELD OF THE INVENTION

This invention relates to a hoisting harness for persons, where the lifting action is taking place by a hoisting harness consisting of a seat-piece, which is placed between the person's legs, to which seat piece a rear-piece is connected. The rear-piece runs on the person's back and upwards over the shoulders. Further, a front piece is connected to the seat-piece, which runs against the person's breast and upwards over the shoulders, whereby the front piece and the rear piece have loops, or the corresponding, protruding from their free ends, which loops will be applied to a lift means e.g. a lift hanger.

BACKGROUND OF THE INVENTION

Hoisting harnesses of this kind are very often so formed that when a person is lifted sitting in the harness, pressure on the chest or against the person's sides will be created and this specifically goes for heavy persons having a corpulent body. The problem is very obvious when lifting disabled persons, old persons or weak persons, who can not use their hands to keep off the tension forces of the hoisting harness.

SUMMARY OF THE INVENTION

An object of the invention is thus to design a hoisting harness, which is comfortable for the lifted person during the lifting action and thereby will not be tight across the chest or at another point of the body and which can be adapted to the size of the person's body.

BRIEF DESCRIPTION OF THE DRAWINGS

An embodiment of the invention will now be described with reference to enclosed drawings.

DETAILED DESCRIPTION OF THE PREFERRED EMBODIMENTS

Figure 1:
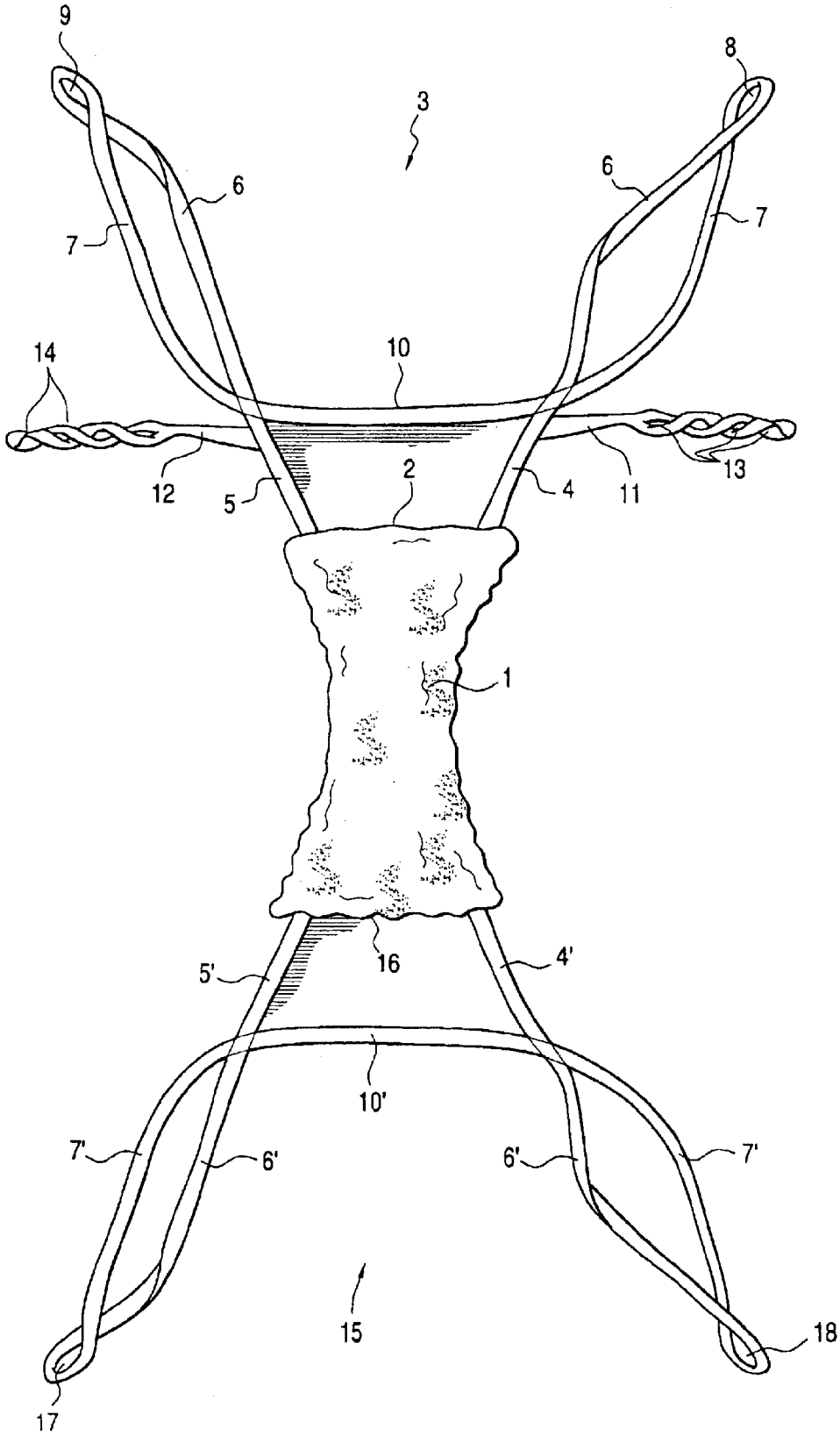
FIG. 1 is hereby a plan view of the harness.

FIG. 1 is thus a plan view of the harness. The harness includes a seat-piece 1 in the form of a piece of a cloth, which is placed between the person's legs. A rear-piece, generally designated by 3 is fastened to the rear end 2 of the seat-piece. This rear-piece 3 consists of two hoisting bands 4 and 5, which are prolonged by two parts 6 and 7, which in their upper ends form a loop 8 and 9 respectively. The hoisting bands 4 and 5 are transversally connected by a transverse band 10.

Two connecting bands 11 and 12 are connected with the hoisting bands 4 and 5 at points approximately where the transverse band 10 is connected to the hoisting bands 4 and 5. The two connecting bands 11 and 12 are composed of several loops 13 and 14 respectively at their free ends.

The hoisting harness also includes a front piece generally indicated by 15. This front piece is connected to the front end 16 of the seat piece and is principally of the same form as the rear piece, and is why it is not described more specifically. The corresponding parts are designated by the same numerals with a prime for parts described concerning the rear piece. However, as shown in FIG. 1, the two lifting loops of the front-piece 15 are designated by 17 and 18.

Figure 2:
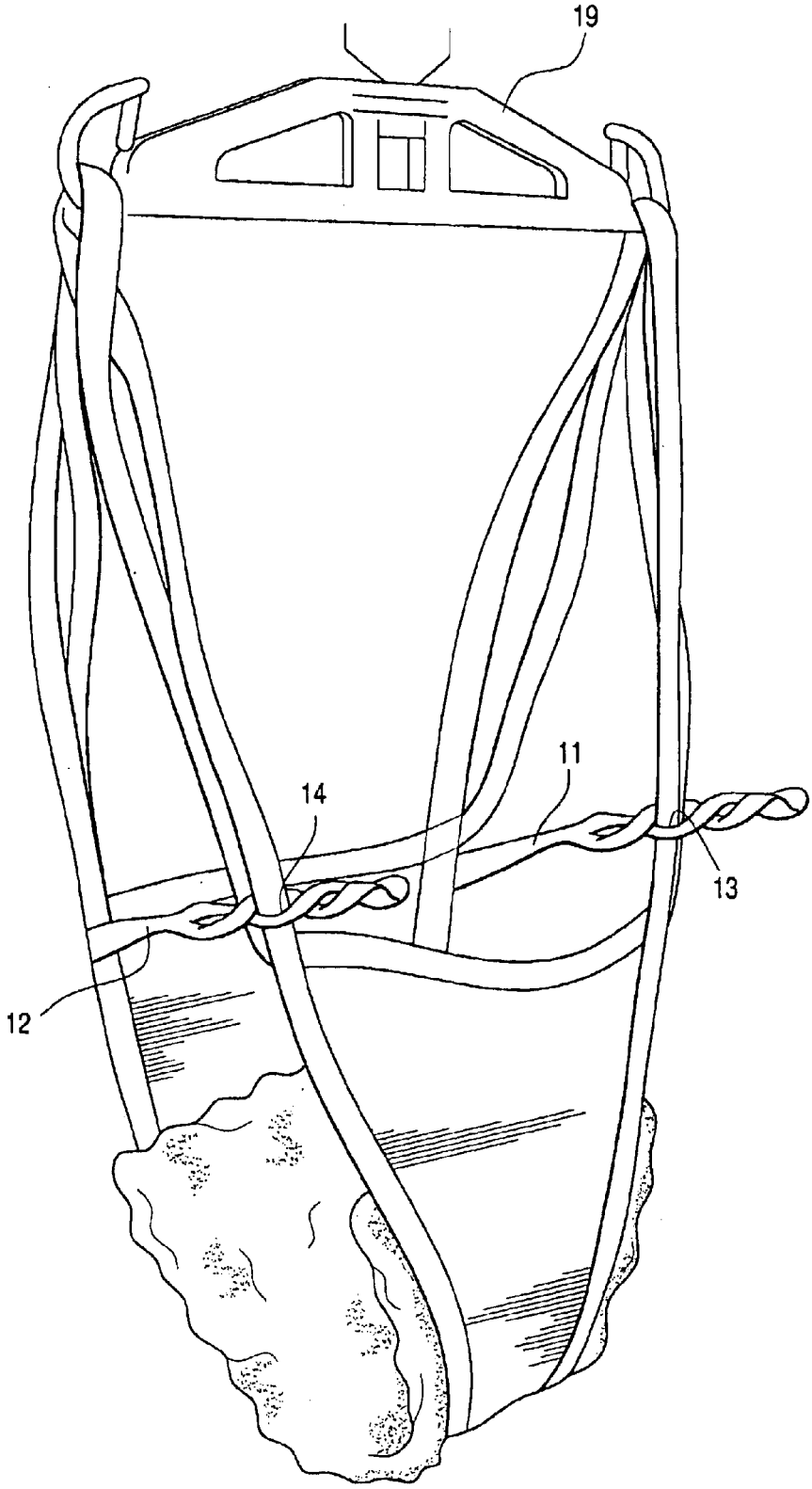
FIG. 2 is a harness according to the invention hanging from a lift hanger without a person being lifted.

In FIG. 2 the harness is shown hanging from a lifting hanger 19. In this form the harness is hanging in the loops 8, 9, 17 and 18. In order to give the harness a closed form the hoisting bands 6' and 7' of the front piece 15 are inserted through any of the loops 13 and 14 respectively of the connecting bands 11 and 12 respectively. A closed harness is thus formed around the person's body by the rear piece 3, the front piece 15 and the two connecting bands 11 and 12, see also FIG. 3. The seat-piece is also included in this closed form of the harness.

Figure 3:
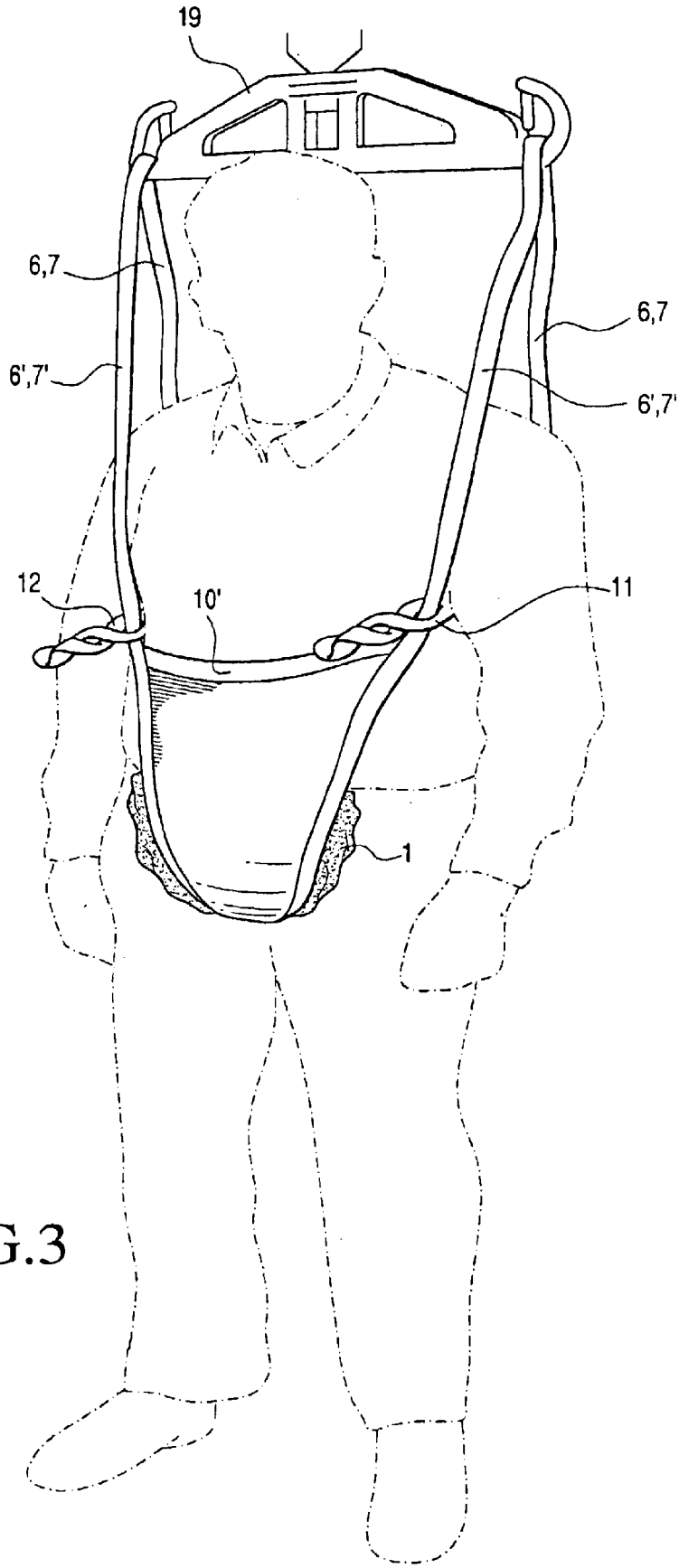
FIG. 3 is a view showing a person being lifted by the harness according to the invention, the harness hanging from a lift hanger.
Figure 4:
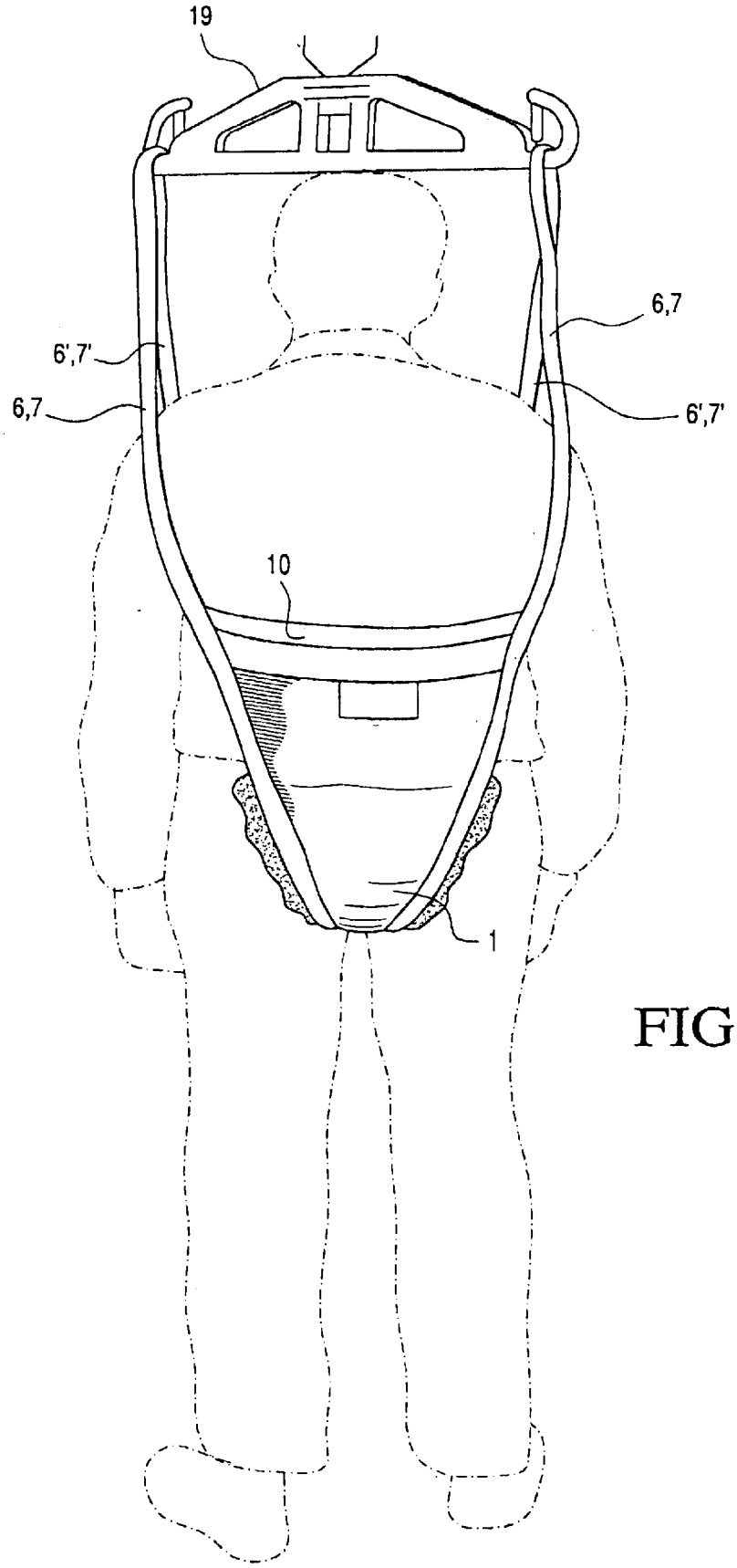
FIG. 4 is the same as FIG. 3 but the person being lifted is seen from the rear.

From FIG. 3 it can be seen that the connecting bands 11 and 12 are placed under the armpits and preferably at a certain distance under the armpits so that the connecting bands do not press uncomfortably into the armpits. By each one of the hoisting bands 6' and 7' inserted in suitable loops 13 and 14, it is possible to arrange the transverse bands 10 and 10' so far from each other that they are not uncomfortably tightened against the chest and the back when the lifting action takes place. The lifting bands will be stretched during the lifting operation, which can have an influence on the tension of the transverse bands 10 and 10'. It should also be observed that the main part of the person's weight will be carried by the seat-piece 1. It is also possible to adapt the harness so that the weight is divided between the seat-piece and the connecting bands by that the latter carry in the armpits. Further, it is also possible that the weight can be carried by the transverse bands 10 and 10' respectively because of a friction between them and the body, respectively.

An embodiment has been described above but within the scope of the claims other embodiments are possible. Thus, the front piece and the rear piece have been described consisting of bands but it is obvious that parts of the front piece and the rear piece can be formed from pieces of cloths instead of bands, at least as far as up to the transverse bands.

What is claimed is:

1. Hoisting harness for persons comprising a seat piece placed between the person's legs, a rear-piece connected to the seat piece, the rear-piece running against the person's back and upwards over the shoulders, a front piece connected to the seat piece, the front piece running against the chest of the person and upwards over the shoulders, the front piece and the rear piece, in free ends having loops for engagement by a lift hanger, a connecting band protruding from each side of the rear piece, the free end of each connecting band having several loops, whereby from each side of the front piece a lifting band protrudes, and is insertable through one, of the loops of the connecting bands so that the person in a comfortable way is sitting on the seat-piece, surrounded by the rear-piece, the front-piece and the two connecting bands.

2. Hoisting harness according to claim 1, wherein the rear-piece as well as the front-piece each consists of two hoisting bands, which are doubled from a point where a transverse band connects the lifting bands.

3. Hoisting harness according to claim 1, wherein the connecting bands are fastened to the rear-piece so that the connecting bands are at a small distance under the person's armpits when the connecting bands connect the rear-piece with the front-piece.

* * * * *